US009664439B2

(12) United States Patent
Mirza et al.

(10) Patent No.: US 9,664,439 B2
(45) Date of Patent: May 30, 2017

(54) ADJUSTABLE SHELF FOR A COOLING DEVICE

(75) Inventors: Alper Mirza, Istanbul (TR); Derya Erturk, Istanbul (TR); Osman Vardar, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 12/811,366

(22) PCT Filed: Dec. 6, 2008

(86) PCT No.: PCT/EP2008/066951

§ 371 (c)(1),
(2), (4) Date: Oct. 12, 2010

(87) PCT Pub. No.: WO2009/083385

PCT Pub. Date: Jul. 9, 2009

(65) Prior Publication Data

US 2011/0016909 A1 Jan. 27, 2011

(30) Foreign Application Priority Data

Dec. 31, 2007 (TR) ..... a 2007 09252

(51) Int. Cl.
*F25D 19/00* (2006.01)
*F25D 25/02* (2006.01)
*F25D 23/04* (2006.01)

(52) U.S. Cl.
CPC ..... *F25D 25/02* (2013.01); *F25D 23/04* (2013.01); *F25D 2325/021* (2013.01)

(58) Field of Classification Search
CPC ..... F25D 25/02; F25D 2325/021
USPC .... 62/377, 440, 449; 211/90.01, 90.02, 193, 211/150, 103; 312/321.5, 408, 405.1
See application file for complete search history.

(56) References Cited

U.S. PATENT DOCUMENTS

| | | | | | |
|---|---|---|---|---|---|
| 2,091,607 | A * | 8/1937 | Nave | 211/153 |
| 2,120,674 | A * | 6/1938 | Newill | 312/308 |
| 2,976,101 | A * | 3/1961 | Rooney | 312/300 |
| 4,186,978 | A * | 2/1980 | Thomson | 312/321.5 |
| 6,220,684 | B1 * | 4/2001 | Bent et al. | 312/405.1 |
| 7,357,469 | B2 * | 4/2008 | Ertz | 312/408 |
| 2010/0253197 | A1 * | 10/2010 | Jung | 312/408 |

FOREIGN PATENT DOCUMENTS

| | | | | |
|---|---|---|---|---|
| JP | 60135594 U | | 9/1985 | |
| JP | 2005003333 | * | 1/2005 | F25D 25/02 |
| JP | 2005003333 A | | 1/2005 | |
| KR | 20040054931 A | | 6/2004 | |
| KR | 20040068782 A | | 8/2004 | |

* cited by examiner

*Primary Examiner* — Keith Raymond
(74) *Attorney, Agent, or Firm* — Kilpatrick Townsend & Stockton LLP

(57) ABSTRACT

A cooling device (1) having a multipurpose shelf (5), used in the door (3) or the body (2), allowing the user to easily enlarge the usable area of the body shelf (4) in line with utilization requirements is described. The shelf can be mounted on the body or the door.

6 Claims, 2 Drawing Sheets

Figure 1
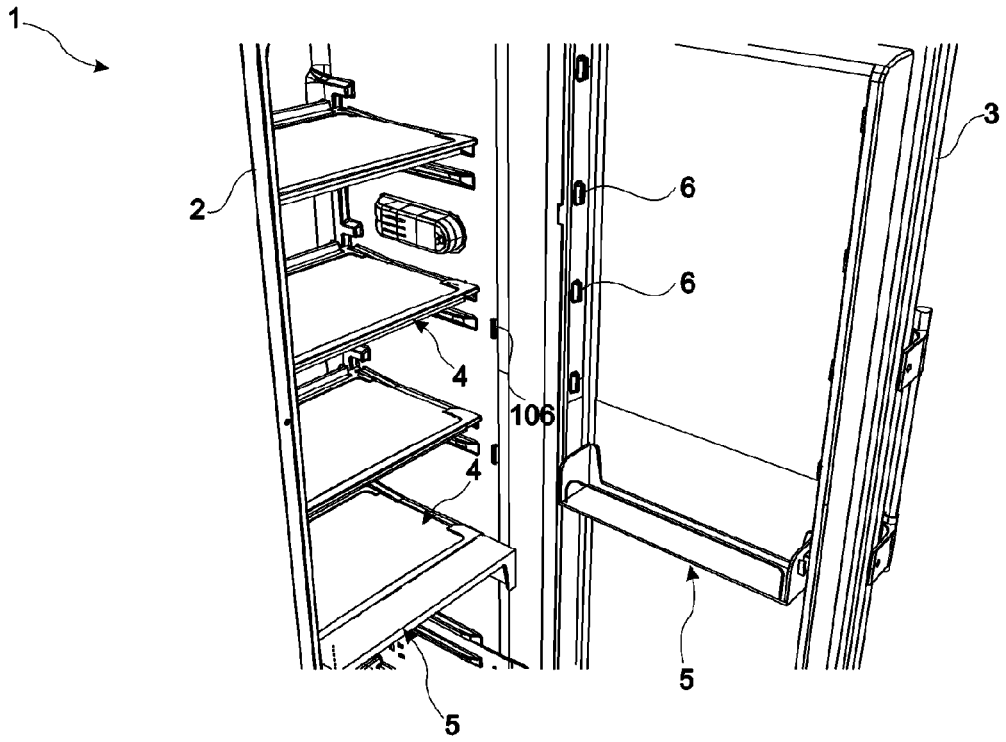
Figurel 3
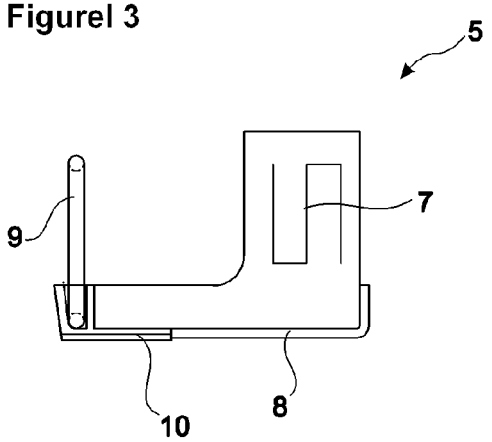
Figure 4
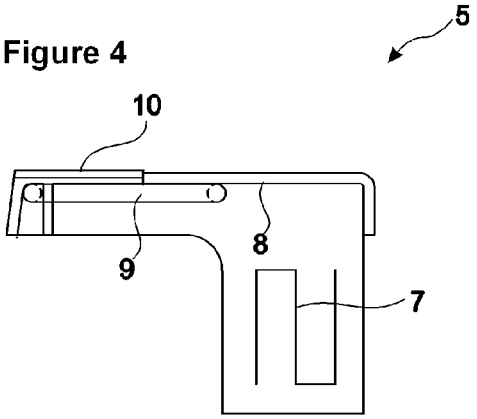

ADJUSTABLE SHELF FOR A COOLING DEVICE

FIELD

The present invention relates to a cooling device comprising a shelf whereof the position inside the body can be changed.

BACKGROUND

In cooling devices, shelves are used that are disposed inside the body and the door, whereon the food and beverage containers are placed. The depth of the shelves disposed inside the body and the door are such that the shelves do not collide with one another when the door is closed. Since the total area of body shelf and the door shelf at almost the same level is constant, the total utilization area is shared between the door shelf and the body shelf at the same level. Difficulties are confronted when the said areas are desired to be used flexibly upon request of the user. The door shelf can be removed out from the body when not wanted to be used but the said area cannot be used for items placed on the body shelf. Therefore various mechanisms are used for maintaining the usage areas of the body and door shelves to be variable at almost the same level.

Such an application is disclosed in the South Korean Patent Application No KR2004-0054931A. In this document, the depth of the body shelf and the door shelf can be changed by means of telescopic mechanisms. This embodiment allows the variable allocation of the utilization space between the door shelf and body shelf at the same level but the telescopic mechanisms cause a considerable increase in costs.

The aim of the present invention is the realization of a cooling device wherein usage flexibility is provided by easily changing the utilization areas of the body shelf and door shelf.

SUMMARY

The cooling device realized in order to attain the aim of the present invention is explicated in the attached claims. The refrigerator of the present invention comprises a shelf that can be mounted on the body or the door, enlarging the utilization area of the body shelf by placing in the front thereof when mounted on the body. The shelf, when mounted to the front of the body shelf, serves as an extension piece added to the front of the body shelf. The shelf, when mounted in front of the body shelf, the carrying surface of the shelf and the carrying surface of the body shelf are joined at the same level and without a gap therebetween. Thus, the utilization area of the shelf is included into the utilization area of the body shelf.

In an embodiment of the present invention, the cooling device comprises retainers situated on the door and the body and carriers fitted to the retainers for holding the shelf at the desired position. In a version of this embodiment, the retainers are configured as protrusions and the carrier is "S" shaped.

In another embodiment of the present invention, the shelf is mounted on the body shelf by means of attachment means situated oppositely on the shelf and the body shelf. Thus, the shelf is integrated to the body shelf.

In an embodiment of the present invention, the cooling device comprises a barrier disposed on the shelf which can be folded when desired.

By means of the shelf that can be used portably in the cooling device, the user can easily widen the utilization area of the body shelf. The shelf is used by mounting on the door when the utilization area of the body shelf is sufficient.

BRIEF DESCRIPTION OF THE DRAWINGS

The cooling device realized in order to attain the aim of the present invention is illustrated in the attached figures, where:

FIG. 1—is the partial perspective view of a cooling device with the door open.

FIG. 3—is the sideways schematic view of a shelf in the door mounted position.

FIG. 4—is the sideways schematic view of a shelf in the body mounted position.

DETAILED DESCRIPTION

Figure 2:
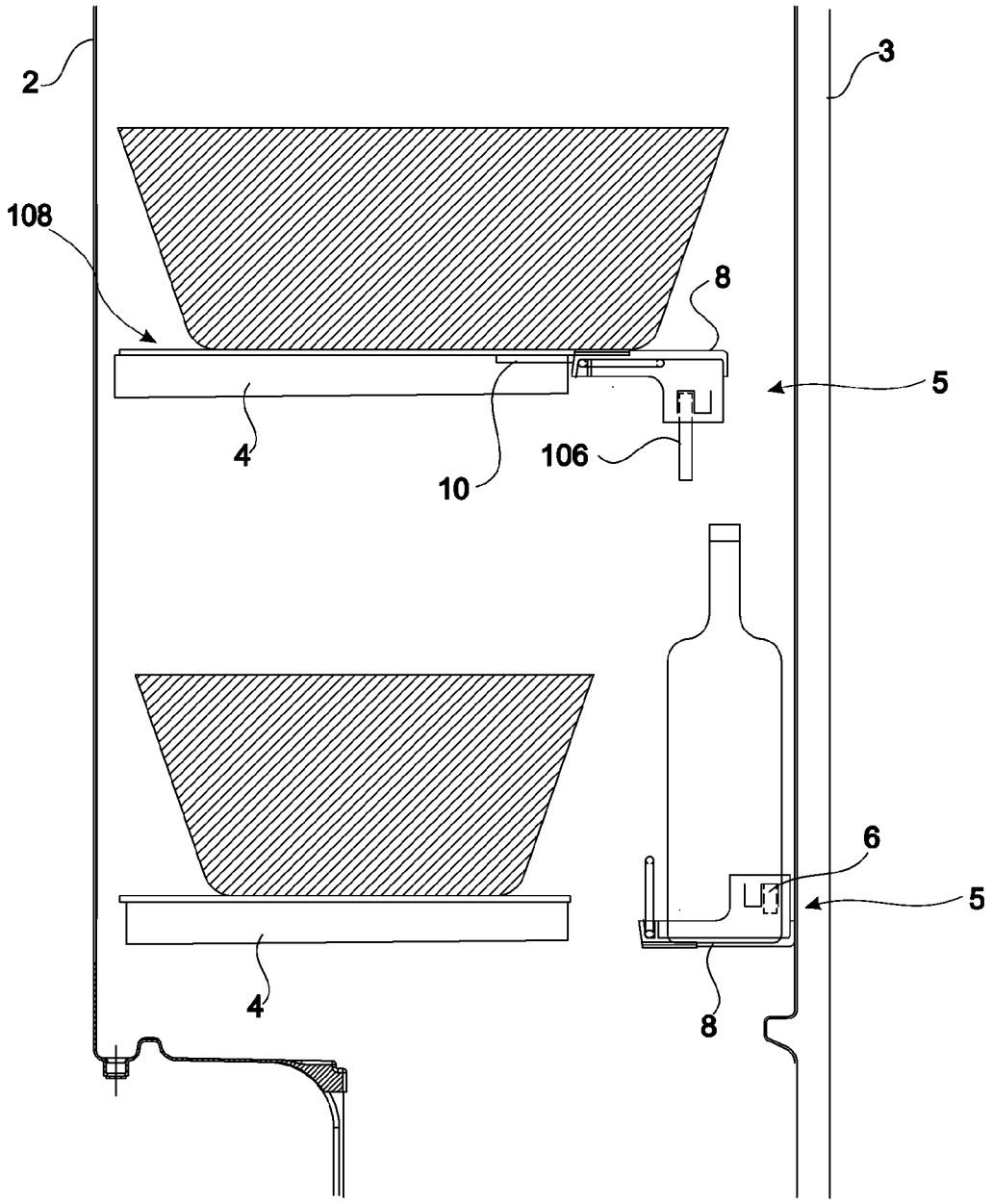
FIG. 2—is the sideways schematic view of a cooling device.

The elements illustrated in the figures are numbered as follows:

1. Cooling device
2. Body
3. Door
4. Body shelf
5. Shelf
6. , 106. Retainer
7. Carrier
8. 108. Carrying surface
9. Barrier
10. Attachment means The cooling device (1) of the present invention comprises a body (2), a door (3), a body shelf (4) disposed in the body (2) having a carrying surface (108) and another shelf (5) having a carrying surface (8).

The shelf (5) can be used at two different positions. In the first position, on the door (3) and in the second position placed in front of the body shelf (4), mounted to the body shelf (4) or the body (2), aligning with the carrying surface (108) such that the carrying surface (108) is widened.

The shelf (5) is virtually at the same level with the body shelf (4) in the first position. When the shelf (5) is detached from the door (3), a usable volume is formed at the level of the body shelf (4), between the door (3) and the body shelf (4). The usable area of the body shelf (4) is widened towards the said volume by mounting the shelf (5) in front of the body shelf (4).

In an embodiment of the present invention, the shelf (5) is mounted in front of/at the front end of the body shelf (4) such that the carrying surface (8) thereof is on the same level with the carrying surface (108) of the body shelf (4). Since the shelf (5) is adjoined with the body shelf (4), there is no gap between the two carrying surfaces (8 and 108). Since the carrying surfaces (8 and 108) are at the same level, the usable area of the body shelf (4) is widened to be equal to the total of the two carrying surfaces (8 and 108). Since the shelf (5) mounted on the door (3) is used in the first position to be virtually at the same level as the body shelf (4) for enlarging the area of the body shelf (4), the door (3) is not obstructed in closing even when the shelf (5) is used in the second position (FIG. 2).

In another embodiment of the present invention, the cooling device (1) comprises carriers (7) disposed on the side edge of the shelf (5), retainers (6) disposed on the door (3) whereto the carriers (7) are seated when the shelf (5) is mounted on the door (3) and retainers (106) on the body (2), in front of the body shelf (4) whereto the carriers (7) are seated when the shelf (5) is mounted on the body (2).

In a version of this embodiment, the retainers (6 and 106) are configured as protrusions. The carrier (7) is formed of two housings, configured by an "S" shaped feeder, the orifice of one being open at the bottom and the orifice of the other being open at the top. In this embodiment, after the shelf (5) is detached from the door (3), the shelf is turned upside down and mounted on the body (2). Accordingly, while one side of the carrying surface (8) is used when the shelf is mounted on the door (3), the other side of the carrying surface (8) is used when mounted on the body (2).

In another embodiment of the present invention, the cooling device (1) comprises carriers (7) disposed on the side edge of the shelf (5), retainers (6) disposed on the door (3) whereto the carriers (7) are seated when the shelf (5) is mounted on the door (3) and attachment means (10), one on the shelf (5) and the other on the body shelf (4), for mounting and locking the shelf (5) to the body shelf (4). In this embodiment, since the shelf (5) is integrated with the body shelf (4) by means of the attachment means (10), the carrying surfaces (8 and 108) are guaranteed not to have a difference of level therebetween.

In another embodiment of the present invention, the cooling device (1) comprises a barrier (9) disposed on the shelf (5). The barrier (9) can be folded under the shelf (5) when the shelf (5) is mounted in front of the body shelf (4). Thus, while the shelf (5) is used on the door (3), the barrier (9) preventing the items placed on the carrying surface (8) from falling, extends downwards from the shelf (5) when the shelf (5) is used by turning upside down in the body (2), thus not causing an inconvenience for the user.

In the cooling device (1) of the present invention, the multipurpose shelf (5) that can be used in the door (3) or the body (2) permits the user to easily widen the body shelf (4) in compliance with the utilization area requirements. Thus the interior space of the cooling device (1) can be arranged easily according to user requirements.

The invention claimed is:

1. A cooling device that comprises a body having body retainers, a door having door retainers, a body shelf disposed in the body and having a carrying surface, a shelf having a carrying surface that is the same width as the carrying surface of the body shelf, the shelf having carriers that are disposed on a side edge of the shelf, the carriers each being formed of first and second housings that are configured as an S-shaped feeder, a first orifice of the first housing being open at the bottom and a second orifice of the second housing being open at the top, and a barrier disposed on the shelf, wherein the shelf is mounted to the door in a first position, and in a second position to the body, in front of the body shelf to be entirely between the body shelf and the door when the door is closed, such that the shelf aligns with and widens the carrying surface of the body shelf, the shelf and the body shelf joined without a gap therebetween, wherein the shelf is seated on the door retainers using the first orifice of the first housing when the shelf is mounted on the door in the first position and the shelf is seated on the body retainers using the second orifice of the second housing when the shelf is mounted on the body in the second position, the shelf being flipped upside-down from the first position to the second position, wherein the barrier retains items placed on the carrying surface of the shelf when the shelf is mounted to the door in the first position, wherein the barrier folds underneath the shelf when the shelf is mounted to the body in the second position.

2. The cooling device as in claim 1, wherein the shelf that is mounted in front of the body shelf such that the carrying surface thereof is on the same level with the carrying surface of the body shelf.

3. The cooling device as in claim 1 or 2, wherein the shelf that is mounted in front of the body shelf such that the two carrying surfaces are joined at the same level.

4. The cooling device as in claim 3 wherein retainers are configured as protrusions.

5. The cooling device as in claim 2, wherein retainers are configured as protrusions.

6. A cooling device that comprises a body having body retainers, a door having door retainers, a body shelf disposed in the body and having a carrying surface, and a shelf having a carrying surface that is the same width as the carrying surface of the body shelf, the shelf also having carriers that are disposed on a side edge of the shelf, the carriers each being formed of first and second housings that are configured as an S-shaped feeder, a first orifice of the first housing being open at the bottom and the second orifice of the other housing being open at the top, and wherein the shelf is mounted to the door in a first position, and in a second position to the body, in front of the body shelf to be entirely between the body shelf and the door when the door is closed, such that the shelf aligns with and widens the carrying surface of the body shelf, the shelf and body shelf joined without a gap therebetween, the shelf being joined to the body shelf by attachment means on both the shelf and the body shelf, wherein the shelf is seated on the door retainers using the first orifice of the first housing when the shelf is mounted on the door in the first position and the shelf is seated on the body retainers using the second orifice of the second housing when the shelf is mounted on the body in the second position, the shelf being flipped upside-down from the first position to the second position.

* * * * *